US010369614B2

(12) United States Patent
Anderzack

(10) Patent No.: US 10,369,614 B2
(45) Date of Patent: Aug. 6, 2019

(54) DIE CLAMP ASSEMBLY FOR A PRESS MACHINE HAVING A POSITION SENSING APPARATUS AND METHOD OF OPERATING A PRESS MACHINE

(71) Applicant: HONDA MOTOR CO., LTD., Tokyo (JP)

(72) Inventor: Robert Daniel Anderzack, Raymond, OH (US)

(73) Assignee: Honda Motor Co., Ltd., Tokyo (JP)

( * ) Notice: Subject to any disclaimer, the term of this patent is extended or adjusted under 35 U.S.C. 154(b) by 645 days.

(21) Appl. No.: 14/705,596

(22) Filed: May 6, 2015

(65) Prior Publication Data

US 2016/0325336 A1 Nov. 10, 2016

(51) Int. Cl.
*B21D 37/14* (2006.01)

(52) U.S. Cl.
CPC ..... *B21D 37/14* (2013.01)

(58) Field of Classification Search
CPC ..... B21D 37/04; B21D 37/12; B21D 37/14; B23Q 1/28; B23Q 3/1552; B23Q 3/15566; B30B 15/026; B30B 15/028
See application file for complete search history.

(56) References Cited

U.S. PATENT DOCUMENTS 3,111,100 A 11/1963 Georgeff
3,134,350 A 5/1964 Danly et al.
3,881,343 A 5/1975 Ducate
4,152,978 A 5/1979 Abe et al.
4,408,521 A 10/1983 Schelli et al.
4,674,315 A * 6/1987 Linz ..... B30B 15/026 100/918
5,234,205 A 8/1993 Shanley
5,715,725 A * 2/1998 Schnell ..... B21D 37/14 72/481.2

OTHER PUBLICATIONS

Serapid Product Overview; "Die Clamping Essentials"; available at http://www.serapid.com/en/industrial-equipment/quick-die-change/die-clamping/die-clamping-essentials; accessed Nov. 5, 2014.
Serapid Product Overview; "Rod and Rotor Clamps" available at http://www.serapid.com/en/industrial-equipment/quick-die-change/die-clamping/rod-and-rotor-clamps; accessed Nov. 5, 2014.
Vektek Product Overview; "TuffCam Swing Clamp: Rod Position Sensing Swing Clamps," Aug. 2014; available at https://www.vektek.com/pdfs/Catalog/en-us/Hydraulic/TuffCamRodPositionSensingSwingClamps.pdf.
Serapid Product Overview; "QDX TB90 Tilting Rod Clamp," Jun. 2008; available at http://www.serapid.com/sites/default/files/public/product-documentation/f1_090-01-tb90-en.pdf.
Serapid Product Guide; "The Complete Program for Quick Die Change," Oct. 2009; available at http://www.serapid.com/en/industrial-equipment/quick-die-change/product-literature.
(Continued)

*Primary Examiner* — Debra M Sullivan
(74) *Attorney, Agent, or Firm* — Armstrong Teasdale LLP

(57) ABSTRACT

A die clamp assembly for a press machine having a first die includes a die clamp configured to couple the first die to the press machine and a position sensing apparatus coupled to the die clamp. The position sensing apparatus being configured to sense proximity of the die clamp assembly to a sensing face of the first die.

17 Claims, 3 Drawing Sheets

(56) References Cited

OTHER PUBLICATIONS

Vektek Product Overview; "TuffCam Swing Clamp: Magnetic Position Sensing Swing Clamps," Aug. 2014; available at https://www.vektek.com/pdfs/Catalog/en-us/Hydraulic/TuffCam-MagneticPositionSensingSwingClamps.pdf.

Carr Lane Roemheld Mfg. Co. Product Overview; "Why Carr Lane Roemheld Swing Clamps?"; available at http://www.clrh.com/CLRSwingClamps.html; accessed Nov. 25, 2015.

* cited by examiner

DIE CLAMP ASSEMBLY FOR A PRESS MACHINE HAVING A POSITION SENSING APPARATUS AND METHOD OF OPERATING A PRESS MACHINE

BACKGROUND

The present disclosure relates generally to methods and systems for verifying die clamp position within a press machine.

Press machines are used for various metal working operations, such as stamping, forming, drawing, shaping, trimming, piercing, bending, or other metal working processes. Press machines are used in many industries, including automobile manufacturing to form various parts of vehicles. The press machines typically accept different die sets for pressing and forming different parts. The die sets are changeable by coupling and uncoupling the various die sets in the press machine. Die clamps are used to securely couple the dies in the press machine.

Problems arise when the die clamps are improperly positioned between the slide of the press machine and the die. For example, operation of the press machine when the operator forgets to put one or more of the die clamps between the slide and the die or when the die clamps are left in the slide and the die during the change-out procedure for the die set may cause damage to the press machine. Components of the press machine may be broken or sheared when the die clamps are improperly positioned. When damage occurs, the press machine experiences downtime for repair. The materials and labor costs for the repairs may be costly. The downtime of the press machine may increase overall manufacture time and costs of the vehicles.

Some known press machines use automated die clamp assemblies that automatically clamp the die to the slide. These assemblies may also include sensors for verifying the position of the clamps. However, such automated die clamp assemblies are expensive. Additionally, they occupy space in front of the press machine, which may interfere with the slide and the transfer mechanism for the die sets.

BRIEF DESCRIPTION

In one embodiment, a die clamp assembly is provided for a press machine, the press machine including a first die. The die clamp assembly includes a die clamp configured to couple the first die to the press machine and a position sensing apparatus coupled to the die clamp. The position sensing apparatus being configured to sense proximity of the die clamp assembly to a sensing face of the first die.

In a further embodiment, a position sensing apparatus is provided including a clamp bracket configured to be coupled to a die clamp, a mount plate extending from the clamp bracket, and a proximity sensor coupled to the mount plate. The proximity sensor is configured to detect proximity to a sensing face of a first die when the die clamp is coupled to the first die and to generate a proximity signal when proximity to the sensing face is detected. The proximity sensor is communicatively coupled to a verification system of a press machine and transmits the proximity signal to the verification system indicating position of the die clamp relative to the first die.

In another embodiment, a press machine is provided including a die set having an upper die and a lower die. The upper die has a mounting location including an upper die slot in an upper die outer face. The upper die has an upper die surface and the lower die having a lower die surface. The die set is configured to press a workpiece between the upper die surface and the lower die surface during a pressing operation. The press machine includes a press slide having a plate positioned above the upper die. The press slide has a mounting location including a plate slot in a plate outer face of the plate. The plate slot is aligned with the upper die slot. The plate is configured to lift the upper die during a lifting operation and is configured to press the upper die during the pressing operation. A die clamp couples the upper die to the plate of the press slide. The die clamp has a head configured to be received in the plate slot of the plate of the press slide. The die clamp has a base configured to be received in the upper die slot of the upper die. The base is hydraulically actuated relative to the head to securely fix the upper die to the plate of the press slide. The die clamp has a proximity sensor coupled to the base. The proximity sensor has a sensor end positioned adjacent at least one of the upper die outer face and the plate outer face to sense a proximity of the sensor end thereto.

In a further embodiment, a method is provided of operating a press machine having a press slide and a first die. The method includes positioning a die clamp in slots in the press slide and the first die to tie the first die to the press slide, coupling a position sensing apparatus to the die clamp, the position sensing apparatus having a proximity sensor, positioning the proximity sensor in proximity to a sensing face of the first die when the die clamp is positioned in the corresponding slots, and sensing proximity of a sensing end of the proximity sensor to the sensing face.

DETAILED DESCRIPTION

Various embodiments of methods and systems for operating a press machine are provided. It should be noted that although the various embodiments are described in connection with the automotive industry, such as for an automobile assembly process, one or more embodiments may be implemented in different industries and for different applications.

One or more embodiments include a proximity sensor for a die clamp used to determine when the die clamp is positioned in a clamping position and to determine when the die clamp is not positioned in the clamping position. The operation of the press machine may be controlled based on signals from the proximity sensor. For example, the press machine may not perform a pressing operation unless the proximity sensor determines that the die clamp is in the clamping position. The die clamp may not be operated or clamped unless the proximity sensor determines that the die clamp is in the clamping position. The die set of the press machine may not be changed if the die clamp is in the clamping position. Other operations may be allowed or restricted based on signals from the proximity sensor. Using the proximity sensor eliminates the need for human visual inspection or verification. Damage to the components of the press machine may be avoided using the automated verification provided by the proximity sensor by restricting certain operations of the press machine when the die clamp is improperly positioned. As such, downtime of the press machine due to damage is reduced, increasing runtime and throughput of the press machine. Additionally, risk of injury is reduced by controlling operation of the press machine based on signals from the proximity sensor.

Figure 1:
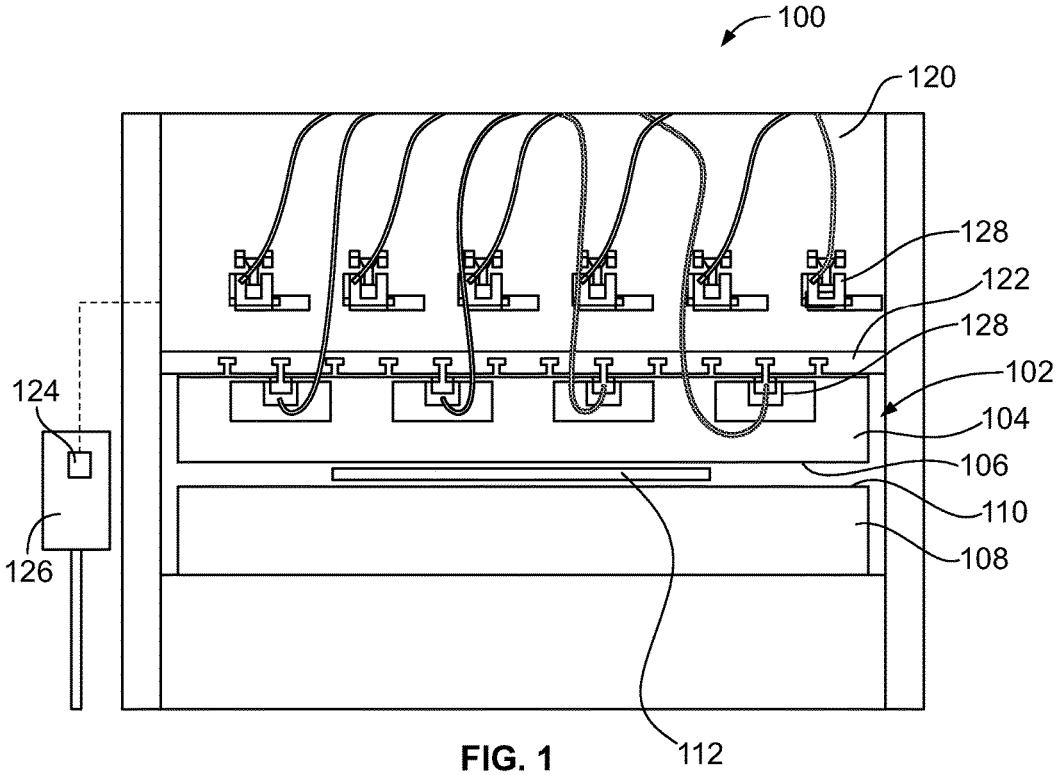
FIG. 1 is a schematic illustration of a press machine in accordance with one embodiment.

FIG. 1 is a schematic illustration of a press machine 100 in accordance with one embodiment. The press machine 100 includes a die set 102 having first and second dies, such as an upper die 104 with an upper die surface 106 and a lower die 108 with a lower die surface 110. The die set may be removable from the press machine 100 and replaceable with a different die set having different upper and lower dies, such as for forming a differently shaped part. The press machine 100 is used to press a workpiece 112 between the upper die surface 106 and the lower die surface 110 to form or shape the workpiece 112 during a pressing operation. The pressing operation of the press machine 100 may be a stamping process, a forming process, a drawing process, a shaping process, a trimming process, a piercing process, a bending process, or another metal working process that is used to manipulate or change the workpiece 112 into a usable component, for example, but not limited to, a frame, panel or hood of a vehicle.

The press machine 100 includes a press slide 120 configured to be coupled to the upper die 104. The press machine 100 raises and lowers the press slide 120 during operation. The press slide 120 is used to lift the upper die 104 upward during a lifting operation and is configured to press the upper die 104 downward during the pressing operation. The press machine 100 may include a plate 122 coupled to the press slide 120 such that the plate 122 moves with the press slide 120. In an exemplary embodiment, the upper die 104 is coupled to the plate 122 using a plurality of die clamps 128. In an exemplary embodiment, the die clamps 128 are hydraulically actuated die clamps that may be hydraulically clamped and unclamped to secure the upper die 104 to the press slide 120. In other words, the die clamps 128 are positioned at least partially within the plate 122 and the upper die 104 and then hydraulically actuated, i.e., clamped, to secure the upper die 104 to the press slide 120. In an exemplary embodiment, the die clamps 128 are manually positioned at least partially within the plate 122 and the upper die 104 prior to actuating the die clamps. For example, the die clamps 128 may be received in slots formed in the plate 122 and in the upper die 104. Alternatively, the die clamps 128 may be automatically positioned to couple the plate 122 and the upper die 104, such as using a robot. 128

Ensuring that the die clamps 128 are properly positioned before and after a die set change reduces the possibility of damage to the various components of the press machine 100, such as the upper die 104 and/or the press slide 120128. For example, all die clamps 128 should be properly positioned and clamped to couple the press slide 120 and the upper die 104 prior to the lifting operation and the pressing operation. Additionally, the die clamps 128 should be removed from the press slide 120 and the upper die 104 prior to removal and replacement of the die set 102. In an exemplary embodiment, the press machine 100 includes a verification system 124 associated with the die clamps 128 that verifies the positions of the die clamps 128 relative to the press slide 120 and/or the upper die 104. The verification system 124 is communicatively coupled to a controller 126 of the press machine 100. Operation of the press machine 100 may be controlled based on signals from the verification system 124 associated with the die clamps 128. Although described herein with respect to upper die 104 and press slide 120, die clamps 128 and verification system 124 may also be applied to secure lower die 108 within press machine 100.

Figure 2:
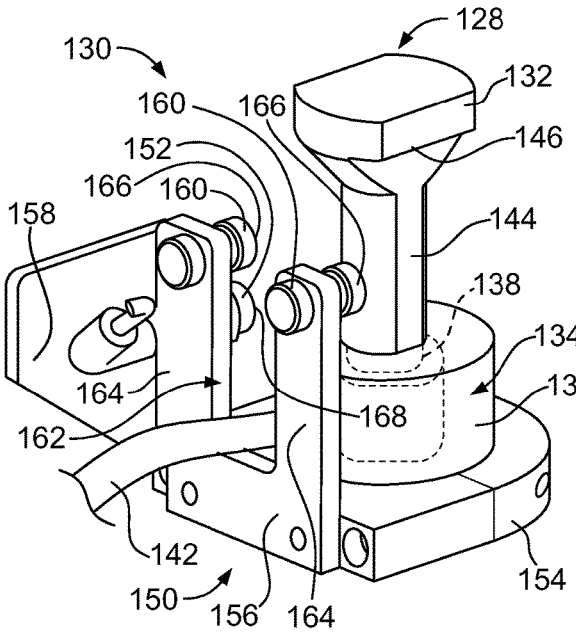
FIG. 2 is a perspective view of a die clamp of the press machine formed in accordance with an exemplary embodiment.
Figure 3:
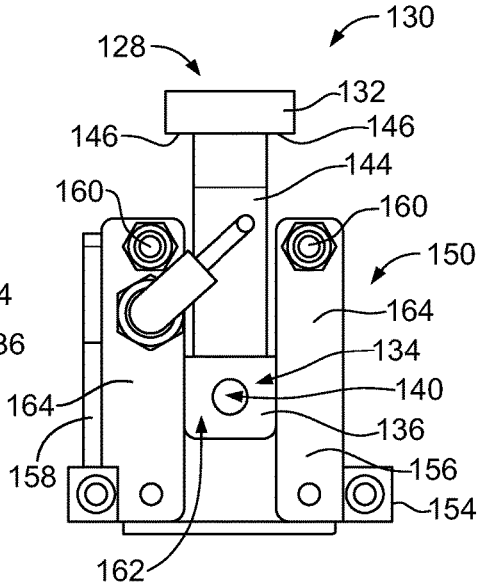
FIG. 3 is a front view of the die clamp shown in FIG. 2.
Figure 4:
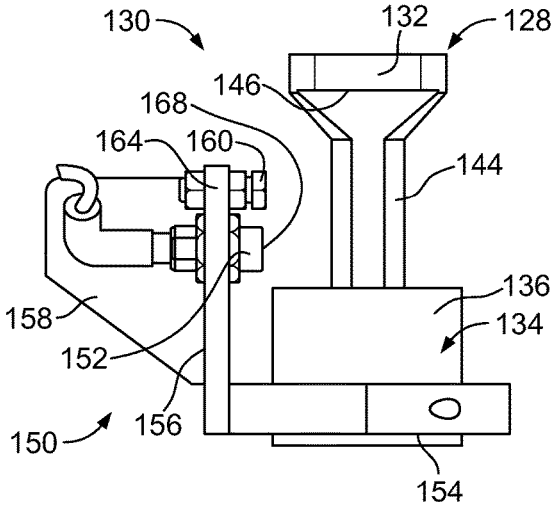
FIG. 4 is a side view of the die clamp shown in FIG. 2.
Figure 5:
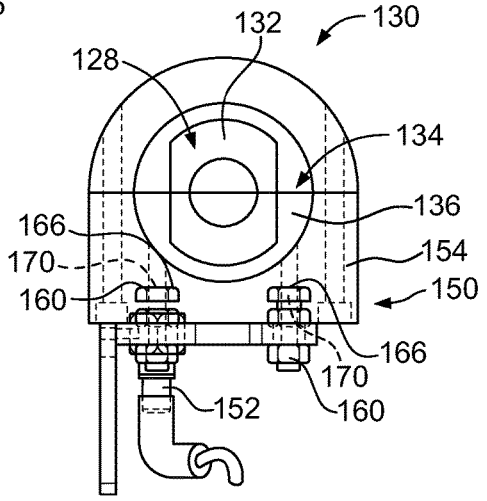
FIG. 5 is a top view of the die clamp shown in FIG. 2.

FIG. 2 is a perspective view of an exemplary die clamp assembly 130 that includes the die clamp 128 shown in FIG. 1 and a position sensing apparatus 150. FIG. 3 is a front view of the die clamp assembly 130. FIG. 4 is a side view of the die clamp assembly 130. FIG. 5 is a top view of the die clamp assembly 130.

The die clamp 128 may be any type of die clamp configured to be positioned between, and clamp together, the press slide 120 and the upper die 104 (both shown in FIG. 1). For example, the die clamp 128 may be a piston-type die clamp, as in the illustrated embodiment. Alternatively, the die clamp may be another type of die clamp, such as a lever-type die clamp or another type of die clamp. In an exemplary embodiment, the die clamp 128 is hydraulically actuated to clamp together the press slide 120 and the upper die 104.

The die clamp 128 includes a head 132 configured to be coupled to the press slide 120. The die clamp 128 includes a base 134 configured to be coupled to the upper die 104. In an exemplary embodiment, the head 132 is movable relative to the base 134, such as when the die clamp 128 is hydraulically actuated.

In an exemplary embodiment, the base 134 includes a hydraulic cylinder 136 and a piston 138 received a hydraulic cylinder 136. The base 134 includes a hydraulic port 140 (shown in FIG. 3), to which a hydraulic hose 142 (shown in FIG. 2) is configured to be coupled. The head 132 is supported by the piston 138 and is movable by the piston 138 relative to the base 134. For example, the head 132 may include a drive arm 144 coupled to the piston 138. The head 132 includes flanges 146 at the distal end thereof. The drive arm 144 and flanges 146 may have a T-shape; however, other shapes are possible in alternative embodiments.

The position sensing apparatus 150 is coupled to the die clamp 130. In an exemplary embodiment, the position sensing apparatus 150 includes a proximity sensor 152, a clamp bracket 154, a mounting plate 156, a shield 158, and a plurality of alignment members 160. The proximity sensor 152 is used by the press machine 100 to verify the location of the die clamp 128. For example, the position sensing apparatus 150 is configured to verify when the die clamp 128 is coupled to the press slide 120 and/or the upper die 104. The proximity sensor 152 is used as part of the verification system 124 of the press machine 100 to verify proper location and/or improper location of the die clamp 128 during various operations of the press machine 100. The proximity sensor 152 may transmit proximity signals to the verification system 124 and/or the controller 126. The controller 126 receives the proximity signals from the proximity sensors 152 and/or the verification system 124 and the controller 126 controls operation of the press machine 100 based on those signals. Optionally, the proximity signals may only be transmitted when the proximity sensor 152 senses an object within the nominal range (e.g., when the proximity sensor 152 is in close proximity to the upper die 104). Alternatively, the proximity sensor 152 may continuously transmit proximity signals, such signals indicative of an object within the nominal range or signals indicative of no object within the nominal range (e.g., a positive signal and a negative signal, respectively). The position sensing apparatus 150 positions the proximity sensor 152 in a predetermined location relative to the head 132 and/or the base 134. The position sensing apparatus 150 may include any structure capable of locating the proximity sensor 152 in a predetermined location.

More specifically, in the illustrated embodiment, the clamp bracket 154 is configured to be coupled to the base 134. The clamp bracket 154 may include one or more pieces that are clamped around the base 134. For example, the clamp bracket 154 may be clamped around the hydraulic cylinder 136. The clamp bracket 154 fixes the relative location of the position sensing apparatus 150 relative to the base 134. In the exemplary embodiment, the clamp bracket 154 is configured to allow the position sensing apparatus 150 to be added to die clamps currently in use that do not include any position verification capabilities.

The mount plate 156 extends from the clamp bracket 154. In the illustrated embodiment, the mount plate 156 is a separate component from the clamp bracket 154 and secured thereto, such as using fasteners. In alternative embodiments, the mount plate 156 and the clamp bracket 154 may be integrally formed from a single piece. The mount plate 156 extends upward from the clamp bracket 154.

The proximity sensor 152 is configured to be coupled to the mount plate 156. The mount plate 156 positions the proximity sensor 152 relative to the head 132 and/or the base 134. Optionally, the proximity sensor 152 may be threadably coupled to the mount plate 156. The position of the proximity sensor 152 may be adjustable, such as to very a depth of a sensor end 168 of the proximity sensor 152 from the mount plate 156. The proximity sensor 152 may be bolted to the mount plate 156 in various embodiments. The proximity sensor 152 may be secured to the mount plate 156 by other known processes in alternative embodiments.

In the illustrated embodiment, the mount plate 156 includes a channel 162 with arms 164 on opposite sides of the channel 162. The channel 162 may be aligned with and provide an opening to the hydraulic port 140 for the hydraulic hose 142. The proximity sensor 152 is coupled to one of the arms 164. In an exemplary embodiment, the alignment members 160 are coupled to both arms 164 on opposite sides of the channel 162. Any number of alignment members 160 may be used in various embodiments. For example, in one embodiment, a single arm 164 may be provided that supports a single alignment member 160.

The shield 158 extends from the mount plate 156, such as along an edge thereof. In the illustrated embodiment, the shield 158 is a separate piece from the mount plate 156 and secured thereto, such as using fasteners. Alternatively, the shield 158 may be integral with the mount plate 156 as a single piece. The shield 158 is positioned near the proximity sensor 152. The shield 158 at least partially surrounds the proximity sensor 152 to shield the proximity sensor 152 and protect the proximity sensor 152 from damage. The shield 158 may protect a portion of the cable extending from the proximity sensor 152. In the illustrated embodiment, the shield 158 extends along one side of the proximity sensor 152; however, the shield 158 may extend along multiple sides and/or entirely enclosed the proximity sensor 152 in alternative embodiments.

The alignment members 160 extend from the mount plate 156. The alignment members 160 are used to align the die clamp 128 with the press slide 120 and/or the upper die 104 when the die clamp 128 is coupled thereto. Optionally, the alignment members 160 may be threadably coupled to the mount plate 156. The alignment members 160 may be secured thereto by other techniques in alternative embodiments.

In an exemplary embodiment, the alignment members 160 are adjustable relative to the mount plate 156, such as to control a position (e.g., depth) of distal ends 166 of the alignment members 160 relative to the mount plate 156. Adjusting the positions of the distal ends 166 may adjust the position of the die clamp 128 relative to the press slide 120 and/or the upper die 104. As such, the position of the proximity sensor 152 relative to the press slide 120 and/or the upper die 104 may be controlled by the alignment members 160. Optionally, the alignment members 160 extend slightly further than the sensor end 168 of the proximity sensor 152 to ensure that the sensor end 168 does not contact the press slide 120 and/or the upper die 104 when the die clamp 128 is coupled thereto.

Optionally, the alignment members 160 may include magnets 170 in the distal ends 166. The magnets 170 are used magnetically attached the alignment members 160 to the press slide 120 and/or the upper die 104 when the die clamp 128 is coupled thereto.

Figure 6:
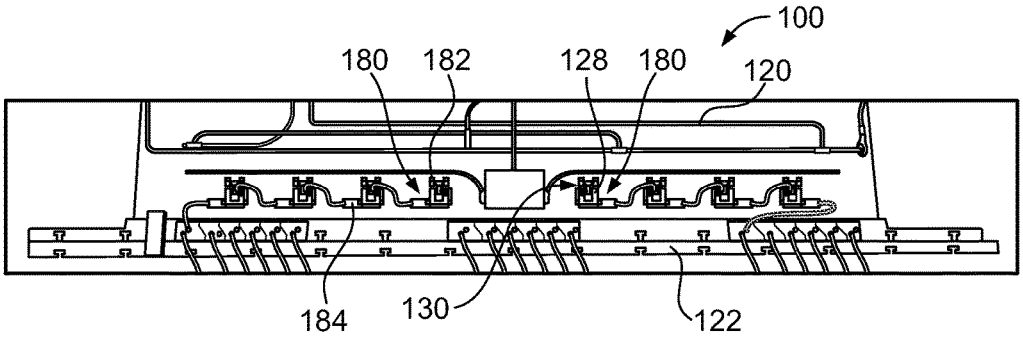
FIG. 6 illustrates a portion of the press machine showing the die clamps stored in storage locations on the press machine in accordance with an exemplary embodiment.
Figure 7:
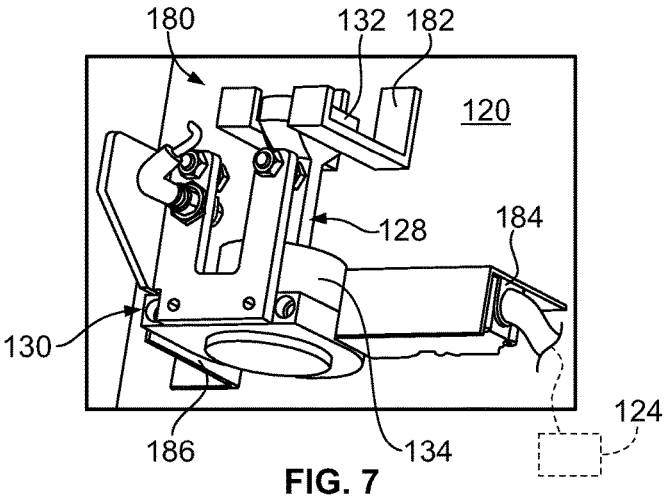
FIG. 7 is an enlarged view of a portion of the press machine showing one of the die clamps in the corresponding storage location in accordance with an exemplary embodiment.

FIG. 6 illustrates a portion of the press machine 100 showing the die clamps 128 stored in storage locations 180 on the press machine 100. FIG. 7 is an enlarged view of a portion of the press machine 100 showing one of the die clamps 128 in the corresponding storage location 180.

Each storage location 180 includes a hanger or bracket 182 used to support and store corresponding die clamp 128. Other securing features may be used in alternative embodiments. The head 132 of the die clamp 128 is received in the bracket 182. The die clamp 128 hangs from bracket 182 such that the base 134 is below the head 132.

In an exemplary embodiment, the press machine 100 includes a storage proximity sensor 184 at each storage location 180. The storage proximity sensor 184 senses the die clamp 128 in the storage location 180. The storage proximity sensor 184 may transmit proximity signals to the verification system 124 of the press machine 100 verifying when the die clamp 128 is present and/or when the die clamp 128 is absent from the storage location 180. The storage proximity sensors 184 may transmit signals to the controller 126. The controller 126 receives signals from the storage proximity sensors 184 and the controller 126 controls operation of the press machine 100 based on those signals. The die clamp 128 hangs from the bracket 182 such that the base 134 is positioned adjacent to the storage proximity sensor 184. The storage proximity sensor 184 may sense the base 134 of the die clamp 128.

Optionally, a brace 186 may be provided in the storage location 180. The die clamp 128 may engage the brace 186 to hold the die clamp 128 in position for sensing by the storage proximity sensor 184. For example, the brace 186 may ensure that the die clamp 128 is positioned within a nominal distance of the storage proximity sensor 184 to ensure that the storage proximity sensor 184 may sense the die clamp 128 when the die clamp 128 is in the storage location 180.

The storage locations 180 may be provided on the press machine 100 above the plate 122 of the press slide 120. The storage locations 180 may be conveniently positioned such that the operator may remove the die clamps 128 to insert the die clamps 128 into the press slide 120 and corresponding upper die 104 (shown in FIGS. 8 and 9). The operator may similarly remove the die clamps 128 from the press slide 120 and upper die 104 and replace the die clamps 128 in the corresponding storage locations 180.

Figure 8:
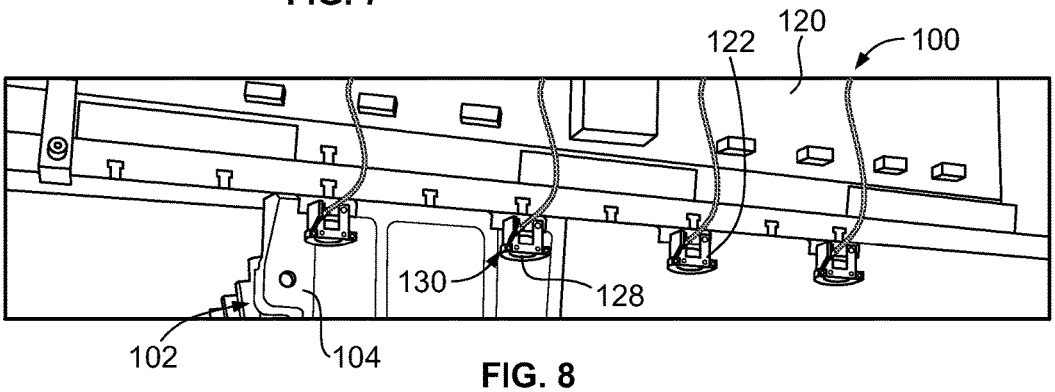
FIG. 8 illustrates a portion of the press machine coupled to a press slide and upper die of the press machine in accordance with an exemplary embodiment.
Figure 9:
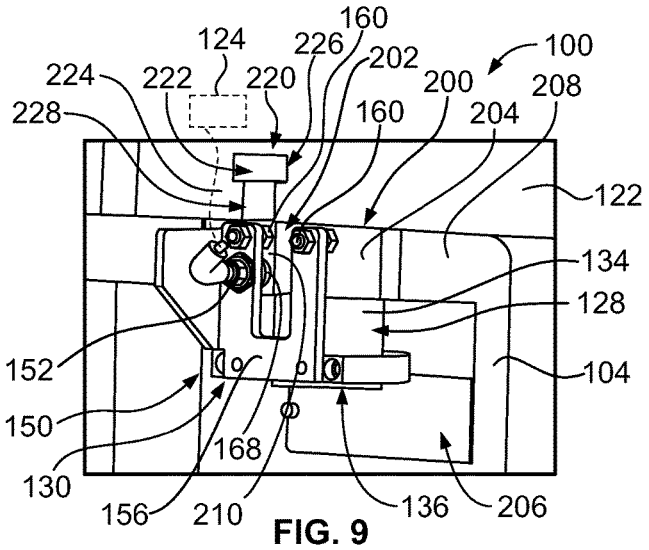
FIG. 9 is an enlarged view of a portion of the press machine showing one of the die clamps coupled to the press slide and the upper die in accordance with an exemplary embodiment.

FIG. 8 illustrates a portion of the press machine 100 coupled to the press slide 120 and the upper die 104. FIG. 9 is an enlarged view of a portion of the press machine 100 showing one of the die clamps 128 coupled to the press slide 120 and the upper die 104.

The upper die 104 has a mounting location 200 for mounting the die clamp 128 to the upper die 104. In an exemplary embodiment, the upper die 104 includes an upper die slot 202 in an upper die outer face 204 at the mounting location 200. Optionally, the upper die slot 202 may be a U-shaped slot open at the outer face 204. The die clamp 128 is configured to be received in the upper die slot 202. For example, a portion of the drive arm 144 and/or the piston 138 (both shown in FIG. 2) may be received in the upper die slot 202.

The upper die 104 includes a pocket 206 below an upper wall 208 of the upper die 104. The upper wall 208 defines the outer face 204. The pocket 206 is configured to receive a portion of the die clamp 128. For example, the base 134 may be received in the pocket 206. The top of the hydraulic cylinder 136 may abut against the upper wall 208 during clamping of the die clamp 128 to the upper die 104.

In an exemplary embodiment, the die clamp 128 is received in the upper die slot 202 such that the proximity sensor 152 is aligned with and held in close proximity to the upper die outer face 204 when the die clamp 128 is coupled to the upper die 104. The sensor end 168 of the proximity sensor 152 faces the outer face 204, which defines a sensing face 210 configured to be sensed. The sensing face 210 may have features or characteristics that allow the sensing face 210 to be sensed by the proximity sensor 152, which may depend on the type of proximity sensor used. For example, the sensing face 210 may be metal. The sensing face 210 may be flat and smooth.

The alignment members 160 are configured to engage the outer face 204 to position the position sensing apparatus 150 and the die clamp 128 with respect to the upper die 104. Optionally, when the alignment members 160 include the magnets 170, the alignment members 160 may be magnetically coupled to the outer face 204. Optionally, when the alignment members 160 are adjustable, the alignment members 160 may be adjusted to control the distance between the sensor end 168 and the outer face 204 to ensure that the proximity sensor 152 is closely positioned to the outer face 204 within a nominal sensing distance of the proximity sensor 152.

In an exemplary embodiment, having multiple alignment members 160 allows the alignment members 160 to orient the position sensing apparatus 150 with respect to the outer face 204. For example, the alignment members 160 may square up the position sensing apparatus 150 with the outer face 204. For example, the mount plate 156 may be oriented parallel to the outer face 204 by adjusting the alignment members 160. In an exemplary embodiment, the alignment members 160 are long enough, and extend beyond the sensor end 168 of the proximity sensor 152, such that the sensor end 168 does not contact the outer face 204, but rather the sensor end 168 is positioned a predetermined distance from the outer face 204, such predetermined distance being within a nominal sensing distance of the proximity sensor 152.

The press slide 120 includes the plate 122. The plate 122 has a mounting location 220 for mounting the die clamp 128 to the upper die 104. In an exemplary embodiment, the plate 122 includes a plate slot 222 in a plate outer face 224 at the mounting location 220. The die clamp 128 is configured to be received in the plate slot 222. For example, the head 132 (shown in FIG. 2) may be received in the plate slot 222. In the illustrated embodiment, the plate slot 222 is a T-shaped slot having a wider portion 226 and a narrower portion 228. The drive arm 144 is received in the narrower portion 228 and the flanges 146 are received in the wider portion 226. The plate slot 222 may have a different shape in alternative embodiments, such as to receive differently shaped die clamps.

During operation of the press machine 100, after the die clamp 128 is loaded into the plate slot 222 and the upper die slot 202, the die clamp 128 may be hydraulically actuated to clamp the upper die 104 to the plate 122. The die clamp 128 may be actuated by other techniques in alternative embodiments, such as pneumatically actuated, electronically actuated, mechanically actuated, and the like. In an exemplary embodiment, the press machine 100 may only actuate the die clamp 128 when the proximity sensor 152 senses the outer face 204. For example, the proximity sensor 152 may only sense the outer face 204 when the die clamp 128 is appropriately loaded into the plate 122 and the upper die 104. When the die clamp 128 is not fully loaded into the plate slot 222 and the upper die slot 202, the proximity sensor 152 may be too far away from the outer face 204 to sense the outer face 204. In an exemplary embodiment, when the die clamp 128 is improperly loaded, no signal is sent from the proximity sensor 152 to the verification system 124 and the press machine 100 may restrict the die clamp 128 from being actuated. As such, the proximity sensor 152 may control operation of the press machine 100. Damage to the various components of the press machine 100 may be reduced or eliminated by using the location verification provided by the proximity sensor 152.

Once the die clamp 128 is actuated, thus clamping the upper die 104 to the plate 122, the press machine 100 may undergo normal pressing operation. Optionally, when any one of the die clamps 128 is improperly positioned, and thus the corresponding proximity sensor 152 does not detect the corresponding outer face 204, the press machine 100 may cease operation. As such, if one of the die clamps 128 is not properly positioned, and thus not clamped to the upper die 104, the press machine 100 may be inoperable.

After operation of the press machine 100, the die clamps 128 may be unclamped and removed from the plate slot 222 and the upper die slot 202. The die clamps 128 may then be returned to the storage locations 180 (shown in FIG. 6). In the storage locations 180, the storage proximity sensors 184 (shown in FIG. 6) sense that all of the die clamps 128 are returned to the proper storage locations 180, allowing the die set 102 to be removed and replaced with a different die set. Until all of the die clamps 128 are in the proper storage locations 180, the die set 102 may not be removed. More specifically, the press machine 100 will not raise the press slide 120 to begin a die set change until the controller 126 receives signals from the proximity sensors 184 indicating that all of the die clamps 128 are in the proper storage locations 180.

In alternative embodiments, the die clamp 128 may be coupled to the press slide 120 in the upper die 104 such that the proximity sensor 152 is aligned with and configured to sense proximity to the plate outer face 224 in addition to, or in the alternative to, sensing the upper die outer face 204. For example, the plate outer face 224 may define a sensing face.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments without departing from their scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112, paragraph (f), unless and until such claim limitations expressly use the phrase "means for" followed by a statement of function void of further structure.

This written description uses examples to disclose the various embodiments, and also to enable a person having ordinary skill in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or the examples include equivalent structural elements with insubstantial differences from the literal language of the claims.

The foregoing description of embodiments and examples has been presented for purposes of illustration and description. It is not intended to be exhaustive or limiting to the forms described. Numerous modifications are possible in light of the above teachings. Some of those modifications have been discussed and other will be understood by those skilled in the art. The embodiments were chosen and described for illustration of various embodiments. The scope is, or course, not limited to the examples or embodiments set forth herein, but can be employed in any number of applications and equivalent devices by those of ordinary skill in the art. Rather it is hereby intended the scope be defined by the claims appended hereto. Additionally, the features of various implementing embodiments may be combined to form further embodiments.

What is claimed is:

1. A die clamp assembly for a press machine, the press machine including a first die, the die clamp assembly comprising:

a die clamp configured to couple the first die to the press machine when the die clamp is inserted into the first die to a clamping position with respect to the first die and the press machine;

a position sensing apparatus coupled to the die clamp and configured to sense proximity of the die clamp assembly to a the first die to determine that the die clamp is inserted into the first die to the clamping position; and a controller communicatively coupled to the position sensing apparatus, wherein the position sensing apparatus is further configured to transmit, in response to the die clamp being inserted into the first die to the clamping position, a proximity signal to the controller, the proximity signal indicating the die clamp is inserted into the first die to the clamping position; and wherein the controller is configured to, in response to receiving the proximity signal, actuate the die clamp.

2. The die clamp assembly of claim 1, wherein the position sensing apparatus determines when the die clamp is inserted into the first die to the clamping position to control operation of the press machine.

3. The die clamp assembly of claim 1, wherein the position sensing apparatus includes a proximity sensor configured to detect presence of the first die within a nominal range of a sensor end of the proximity sensor to determine when the die clamp is inserted into the first die to the clamping position.

4. The die clamp assembly of claim 1, wherein the position sensing apparatus includes a proximity sensor located exterior of the first die and configured to sense the first die.

5. The die clamp assembly of claim 1, wherein the die clamp includes a head configured to be coupled to a press slide of the press machine and a base configured to be coupled to the first die, the base being hydraulically actuated relative to the head to securely fix the first die to the press slide, the position sensing apparatus being coupled to the base and held in position to detect the first die when the head and the base are inserted into the press slide and the first die, respectively.

6. The die clamp assembly of claim 5, wherein the position sensing apparatus comprises a clamp bracket coupled to the base and a mount plate extending from the clamp bracket, the position sensing apparatus comprising a proximity sensor being coupled to the mount plate.

7. The die clamp assembly of claim 6, further comprising a shield coupled to at least one of the clamp bracket and the mount plate, the shield at least partially surrounding the proximity sensor to shield the proximity sensor.

8. The die clamp assembly of claim 5, wherein the position sensing apparatus comprises a proximity sensor and an alignment member, the alignment member being configured to engage the first die to position the proximity sensor relative to the first die.

9. The die clamp assembly of claim 8, wherein the alignment member comprises a magnet configured to magnetically attach the alignment member to the first die.

10. The die clamp assembly of claim 8, wherein the alignment member is a first alignment member, the position sensing apparatus further comprising a second alignment member, the first and second alignment members being configured to square up the position sensing apparatus and position a sensor end of the proximity sensor a predetermined distance from the first die.

11. The die clamp assembly of claim 8, wherein the alignment member is adjustable relative to the proximity sensor to adjust a relative position of a sensor end of the proximity sensor to the first die when the die clamp is inserted into the press slide and the first die.

12. The die clamp assembly of claim 1, wherein the position sensing apparatus comprises a proximity sensor and an alignment member, the alignment member being configured to engage the first die to position the proximity sensor relative to the first die, wherein the alignment member extends beyond a sensor end of the proximity sensor to prevent contact between the sensor end of the proximity sensor and the first die.

13. A press machine comprising:

a first die;

a die clamp assembly comprising:

a die clamp configured to couple the first die to the press machine when the die clamp is inserted into the first die to a clamping position with respect to the first die and the press machine; and a position sensing apparatus coupled to the die clamp and configured to sense proximity of the die clamp assembly to the first die to determine that the die clamp is inserted into the first die to the clamping position; and a controller communicatively coupled to the position sensing apparatus, wherein the position sensing apparatus is further configured to transmit, in response to the die clamp being inserted into the first die to the clamping position, a proximity signal to the controller, the proximity signal indicating the die clamp is inserted into the first die to the clamping position, and wherein the controller is configured to, in response to receiving the proximity signal, actuate the die clamp.

14. The press machine of claim 13, wherein the position sensing apparatus includes a proximity sensor configured to detect presence of the first die within a nominal range of a sensor end of the proximity sensor to determine when the die clamp is inserted into the first die to the clamping position.

15. The press machine of claim 13 further comprising a press slide, wherein the die clamp comprises:

a head configured to be coupled to the press slide; and a base configured to be coupled to the first die, the base being hydraulically actuated relative to the head to securely fix the first die to the press slide, wherein the position sensing apparatus is coupled to the base and held in position to detect the first die when the head and the base are inserted into the press slide and the first die, respectively.

16. The press machine of claim 13, wherein the position sensing apparatus comprises a proximity sensor and an alignment member, the alignment member being configured to engage a face of the first die to position the proximity sensor relative to the face of the first die.

17. The press machine of claim 16, wherein the alignment member extends beyond a sensor end of the proximity sensor to prevent contact between the sensor end of the proximity sensor and the face of the first die.

* * * * *